US005435154A

United States Patent [19]

Nishiguchi et al.

[11] Patent Number: 5,435,154

[45] Date of Patent: Jul. 25, 1995

[54] HIGH TEMPERATURE REGENERATOR OF AN ABSORPTION TYPE HOT AND COLD WATER GENERATOR AND ABSORPTION TYPE HOT AND COLD WATER GENERATOR

[75] Inventors: Akira Nishiguchi, Ushiku; Tomihisa Ohuchi, Tsukuba; Shigeo Sugimoto; Michihiko Aizawa, both of Ushiku; Takao Naruse, Ibaraki; Yasuo Uraki, Tsuchiura, all of Japan

[73] Assignee: Hitachi, Ltd., Tokyo, Japan

[21] Appl. No.: 181,022

[22] Filed: Jan. 14, 1994

[30] Foreign Application Priority Data

Jan. 26, 1993 [JP] Japan ..... 5-010469

[51] Int. Cl.[6] ..... F25B 15/00

[52] U.S. Cl. ..... 62/476; 62/497; 122/18

[58] Field of Search ..... 62/497, 476; 122/140.2, 122/145, 18, 235.14, 235.15, 260, 261, 333, 195

[56] References Cited

U.S. PATENT DOCUMENTS

| | | | |
|---|---|---|---|
| 29,334 | 7/1860 | Vaile | 122/260 |
| 1,865,958 | 7/1932 | Prinz | 122/260 |
| 3,254,507 | 6/1966 | Whitlow | 62/497 |
| 4,106,309 | 8/1978 | Phillips | 62/476 |
| 4,383,499 | 5/1983 | Rackham et al. | 122/18 |
| 4,413,590 | 11/1983 | Landreau | 122/18 |
| 4,499,859 | 2/1985 | Nishiguchi et al. | 122/18 |
| 5,282,507 | 2/1994 | Tongu et al. | 165/165 |

FOREIGN PATENT DOCUMENTS

| | | | |
|---|---|---|---|
| 4116356 | 4/1992 | Japan | 62/476 |

OTHER PUBLICATIONS

*Fundamentals of Classial Thermodynamics* Gordon J. Van Wylen and Richard E. Sonntag. 3rd edition 1985 John Wiley and Sons New York pp. 309–310.

Japanese Patent Unexamined Publication No. 58-198661 May 1982.

*Primary Examiner*—Henry A. Bennet
*Assistant Examiner*—William C. Doerrler
*Attorney, Agent, or Firm*—Antonelli, Terry, Stout & Kraus

[57] ABSTRACT

A high temperature regenerator of an absorption type hot and cold water generator and an absorption type hot and cold water generator capable of preventing corrosion from occurring by preventing local overheating at the heat transfer surface of the high temperature regenerator and capable of being miniaturized. The high temperature regenerator includes an outer case, an inner case, a plurality of solution pipes, a burner, a solution flow-in pipe, and a gas/liquid separation plate. The inner case is inside the outer case, and a solution is kept between the cases, with the inner case being submerged within this solution. The burner is mounted on the side of the outer case in such a way that heat can be supplied through the inner case, with the inside of the inner case serving as a combustion chamber. A plurality of solution pipes, through which the upper and lower portions of the inner case are connected, are disposed downstream of the combustion chamber, and the inside of each of the solution pipes is filled with the solution. The horizontal cross section of each of the solution pipes is elliptical, and two or more of the solution pipes are disposed so that the straight line portions in the elliptical shape become parallel to each other. The sections between the solution pipes serve as a combustion gas passage.

5 Claims, 10 Drawing Sheets

HIGH TEMPERATURE REGENERATOR OF AN ABSORPTION TYPE HOT AND COLD WATER GENERATOR AND ABSORPTION TYPE HOT AND COLD WATER GENERATOR

BACKGROUND OF THE INVENTION

1. Field of the Invention

The present invention relates to a high temperature regenerator of an absorption type hot and cold water generator and an absorption type hot and cold water generator using the high temperature regenerator.

2. Background of the Invention

A conventional high temperature regenerator of an absorption type hot and cold water generator is disclosed in, for example, Japanese Patent Unexamined Publication No. 58-198661. More particularly, the absorption type hot and cold water generator is formed of an outer case and an inner case, with a solution being maintained in section between the outer case and the inner case, and with a part of the inner case serving as a combustion chamber of a combustor for heating the solution. A and a plurality of solution pipes are disposed in a downstream portion inside the inner case in a substantially vertical manner, and, after a combustion gas from the combustor heats the wall of the combustion chamber surrounded by the solution, the combustion gas passes between the solution pipes to heat outer walls of the pipes. The pipes are arranged in a zigzag form, and pipes with fins are used in the downstream portion of the combustion gas, in order to improve heat transfer.

Since a lithium bromide solution, which is heated and boiled by a high temperature regenerator, shows high corrosiveness at high temperatures, it is not allowed to increase the temperature of a heat transfer surface more than a fixed value. Therefore, in such above-described prior art, a heat load in the front side of a heat transfer pipe with respect to the combustion gas flow differs from the rear side thereof, design of heat transfer is effected at a point on the front side of the heat transfer pipe at which a heat load is the highest and the temperature of the heat transfer surface becomes high. In this case a problem arises in that, since the combustion gas stagnates at the rear side of the heat transfer pipe, the heat load is reduced; therefore a large heat transfer area is required, and a high temperature regenerator having a large construction. When, in contrast, an attempt is made to increase the overall average heat load another problem arises in that local overheating occurs at the front side of the heat transfer pipe, and the corrosion of the heat transfer surface increases. In particular, in heat transfer pipes arranged in a zigzag form, since the combustion gas accelerated by passing through the area between the first row of pipes strikes against the front ends of the pipes in the second row, the front ends of the pipes in the second row overheat and corrosion increases.

SUMMARY OF THE INVENTION

It is an object of the present invention to provide a high temperature regenerator of an absorption type hot and cold water generator and an absorption type hot and cold water generator, which is capable of preventing corrosion from occurring by preventing local overheating at the heat transfer surface of the high temperature regenerator and which can be miniaturized.

According to the present invention, there is provided a high temperature regenerator of an absorption type hot and cold water generator which comprises an outer case, an inner case a plurality of solution pipes and a liquid chamber for holding a solution being formed in a section between the outer case and the inner case. A combustion chamber through which a combustion gas for heating the solution flows is formed inside the inner case, and the plurality of solution pipes are arranged downstream of the combustion gas flow inside the combustion chamber. Each of the plurality of solution pipes is vertically connected to the liquid chamber so that the inside of each of the solution pipes is filled with a solution and the solution does not enter the space of the combustion chamber outside the solution pipes. A cross section of each of the plurality of solution pipes is flat with respect to the flow of the combustion gas.

According to the present invention an absorption type hot and cold water generator, to which a high temperature regenerator, a low temperature regenerator, a condenser, an evaporator and an absorbing unit are connected to form a refrigerating cycle. A high temperature is formed of an outer case, an inner case, and a plurality of solution pipes, with the high temperature regenerator, having a liquid chamber for holding a solution, being formed in a section between the outer case and the inner case. A combustion chamber through which a combustion gas for heating the solution flows is formed inside the inner case, with the plurality of solution pipes being arranged downstream of the combustion gas flow inside the combustion chamber. Each of the plurality of solution pipes are vertically connected to the liquid chamber so that the inside of each of the solution pipes is filled with a solution and the solution does not enter the space of the combustion chamber outside the solution pipes. A cross section of each of the plurality of solution pipes is flat with respect to the flow of the combustion gas.

Since the solution pipes are flat with respect to the flow of the combustion gas, there is no place where the combustion gas stagnates and a heat load becomes small. Also, the heat flux on the heat transfer surface varies uniformly, and it is difficult for local overheating to occur. Therefore, it is possible to prevent corrosion of the heat transfer surface from progressing.

The above and further objects, aspects and novel features of the invention will more fully appear from the following detailed description when the same is read in connection with the accompanying drawings. It is to be expressly understood, however, that the drawings are for the purpose of illustration only and are not intended to limit the definition of the invention.

DESCRIPTION OF THE PREFERRED EMBODIMENTS

Figure 1:
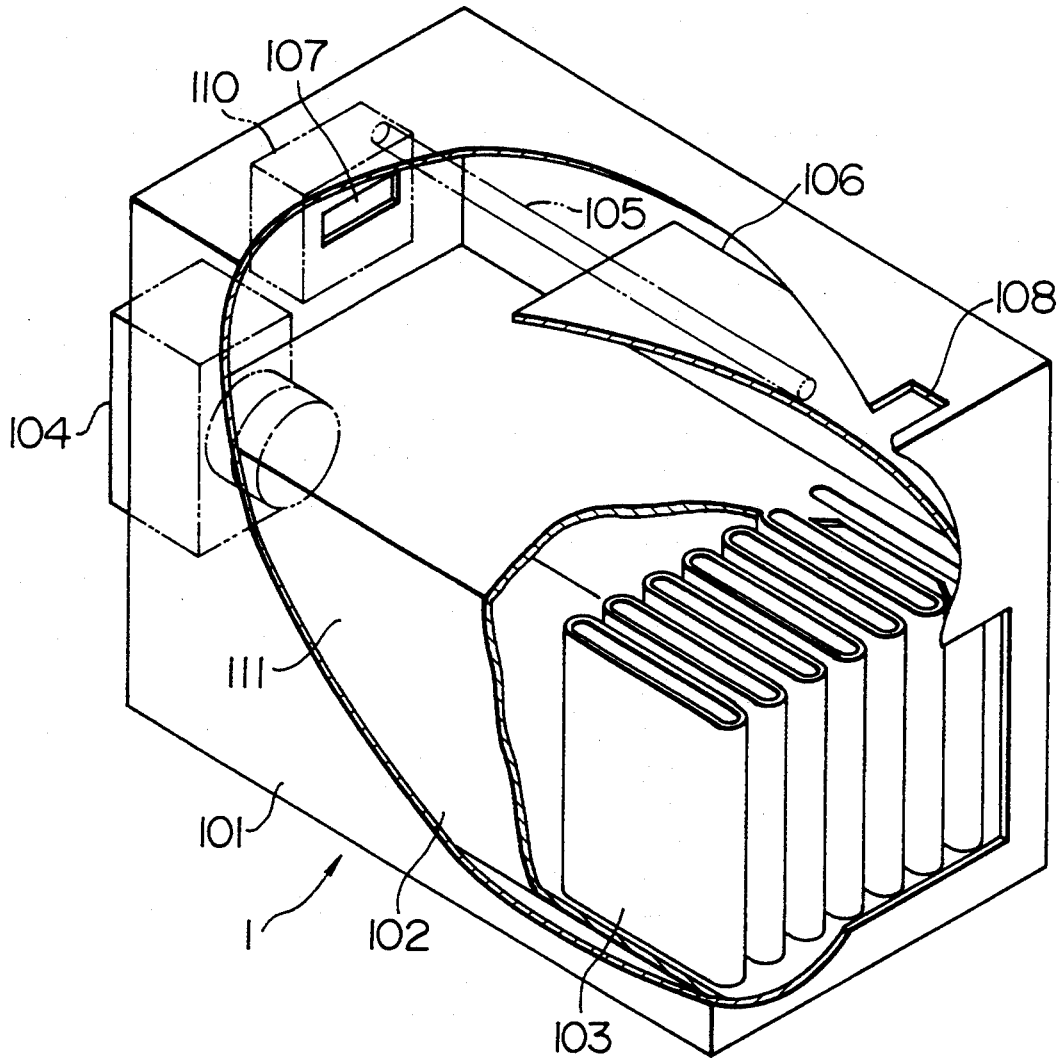
FIG. 1 is a partial cutaway perspective view of a high temperature regenerator in accordance with an embodiment of the present invention.
Figure 2:
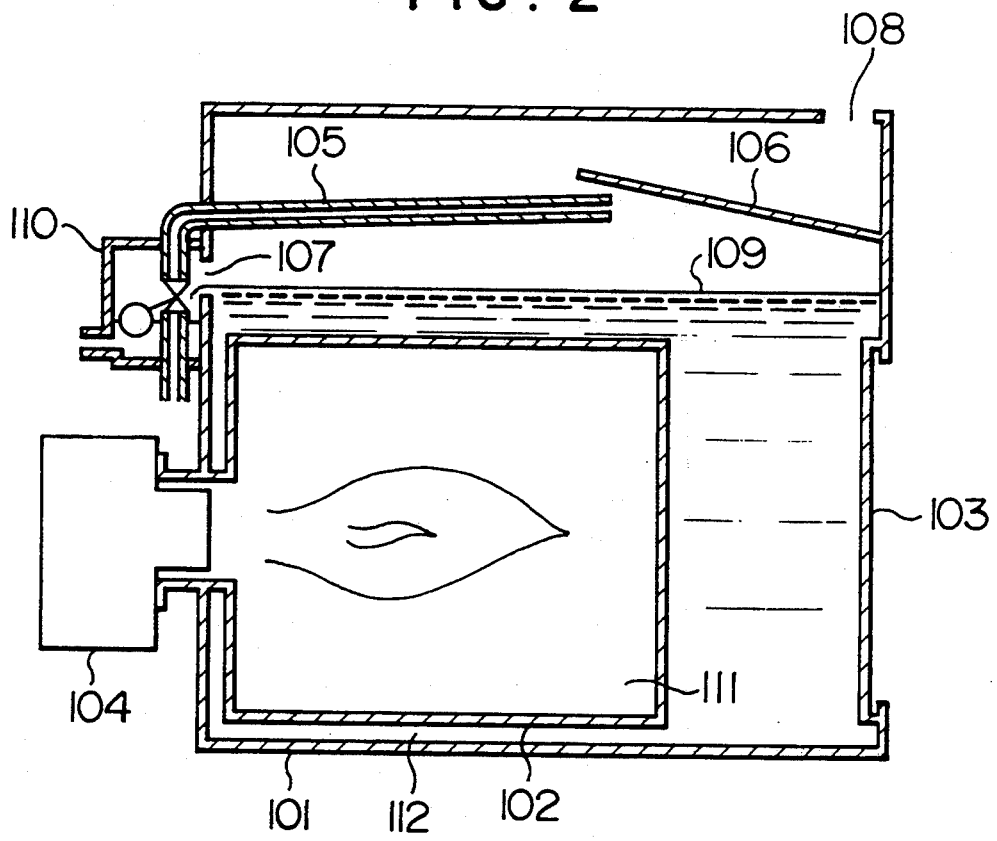
FIG. 2 is a cross sectional view of the high temperature regenerator of FIG. 1.
Figure 3:
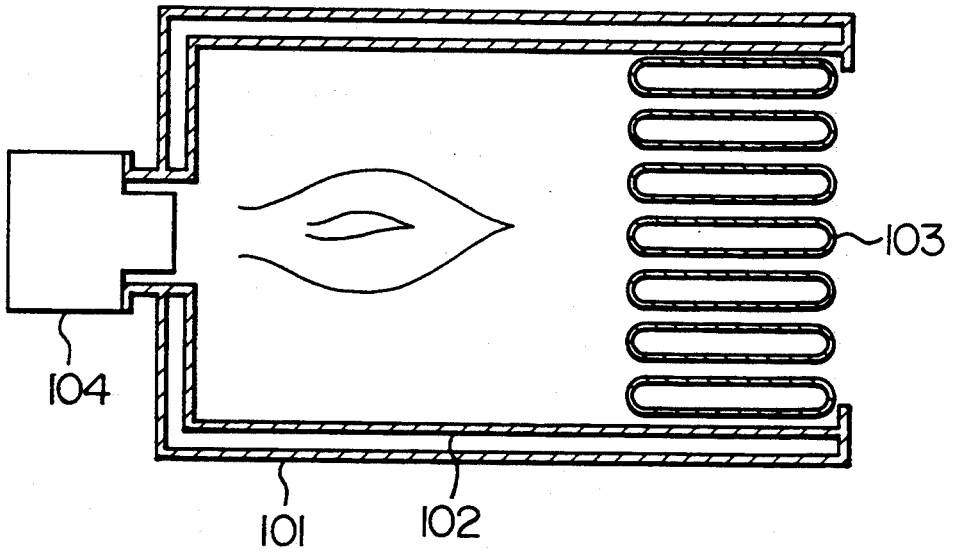
FIG. 3 is a cross sectional view of the high temperature regenerator of FIG. 1.

A high temperature regenerator 1 comprises an outer case 101, an inner case 102, a plurality of solution pipes 103, a burner 104, solution input pipe 105, and a gas/liquid separation plate 106. The inner case 102 is inside the outer case 101, with and a solution 109 is kept between the cases, the inner case 102 being submerged within this solution 109. The burner 104 is mounted on the side of the outer case 101 in such a manner that heat can be supplied through the inner case 102, and the inside of the inner case 102 serves as a combustion chamber 111. The outer case 101 and the inner case 102 form a liquid chamber 112. The plurality of solution pipes 103, through which the upper and lower portions of the liquid chambers 112 with respect to the inner case 102 are connected to each other, are disposed in the downstream of the combustion chamber 111, with the inside of the pipes being filled with the solution 109. Since the upper and lower ends of the plurality of solution pipes 103 are joined in a liquid-tight manner to the upper and lower walls of the inner case 102 within the inner case 102, the solution in the solution pipes 103 communicates with the solution in the liquid chamber 112 but does not enter the inner case 102.

The plurality of solution pipes 103 has an elliptical (or flat) horizontal cross section, and the plurality of solution pipes 103 are arranged in a row so that the straight line portions in the elliptical shape become parallel to each other. The sections between the solution pipes 103 serve as combustion gas passages. The solution input pipe 105 and the gas/liquid separation plate 106 are disposed above the solution 109 inside the outer case 101. A solution discharge hole 107 is disposed on the side of the outer case 101, and a refrigerant vapor discharge hole 108 is disposed on the top side thereof. A float box 110 is communicated through the solution discharge hole 107 to the outer case 101 and the solution discharge pipe 105 is communicated through the float box 110 to the inside of the outer case 101. A float valve is disposed in the middle of the solution input pipe 105 inside the float box 110, so that the flow rate of a solution to be supplied to the high temperature regenerator 1 can be adjusted on the basis of the depth of the liquid inside the float box.

Combustion gas from the burner 104 heats the solution 109 mainly by radiative heat transfer through the wall of the inner case 102, then heats the solution 109 inside the solution pipes 103 by convective heat transfer while passing through the passage sandwiched by the flat plate surfaces of the adjacent solution pipes 103, and then is discharged to the outside. The heated solution 109 boils and generates refrigerant vapor. The generated refrigerant vapor becomes an ascending flow and rises inside the solution pipes 103 and in the passage between the outer case 101 and the inner case 102, goes above the liquid surface, goes around the gas/liquid separation plate 106 and exits from the refrigerant vapor discharge hole 108; whereas the solution is guided into the high temperature regenerator 1 through the solution input pipe 105, and is heated to boil inside the high temperature regenerator 1. The solution whose concentration has increased is discharged to the float box 110 through the solution discharge hole 107. The solution having increased concentration is temporarily collected in the float box 110 so as to form the liquid surface and is discharged.

According to this embodiment, as described above, since the heat transfer surface where heat exchange between combustion gas and the solution is performed is a flat plate, there is no place where the combustion gas stagnates and the heat load becomes small. Accordingly, an average heat flux can be increased, and the high temperature regenerator can be miniaturized. Also, since the heat transfer surface is a flat plate, it is difficult for local overheating to occur, thereby preventing the heat transfer surface from being corroded locally.

The solution pipes 103 can be manufactured easily by changing the shape of a circular pipe.

Figure 4:
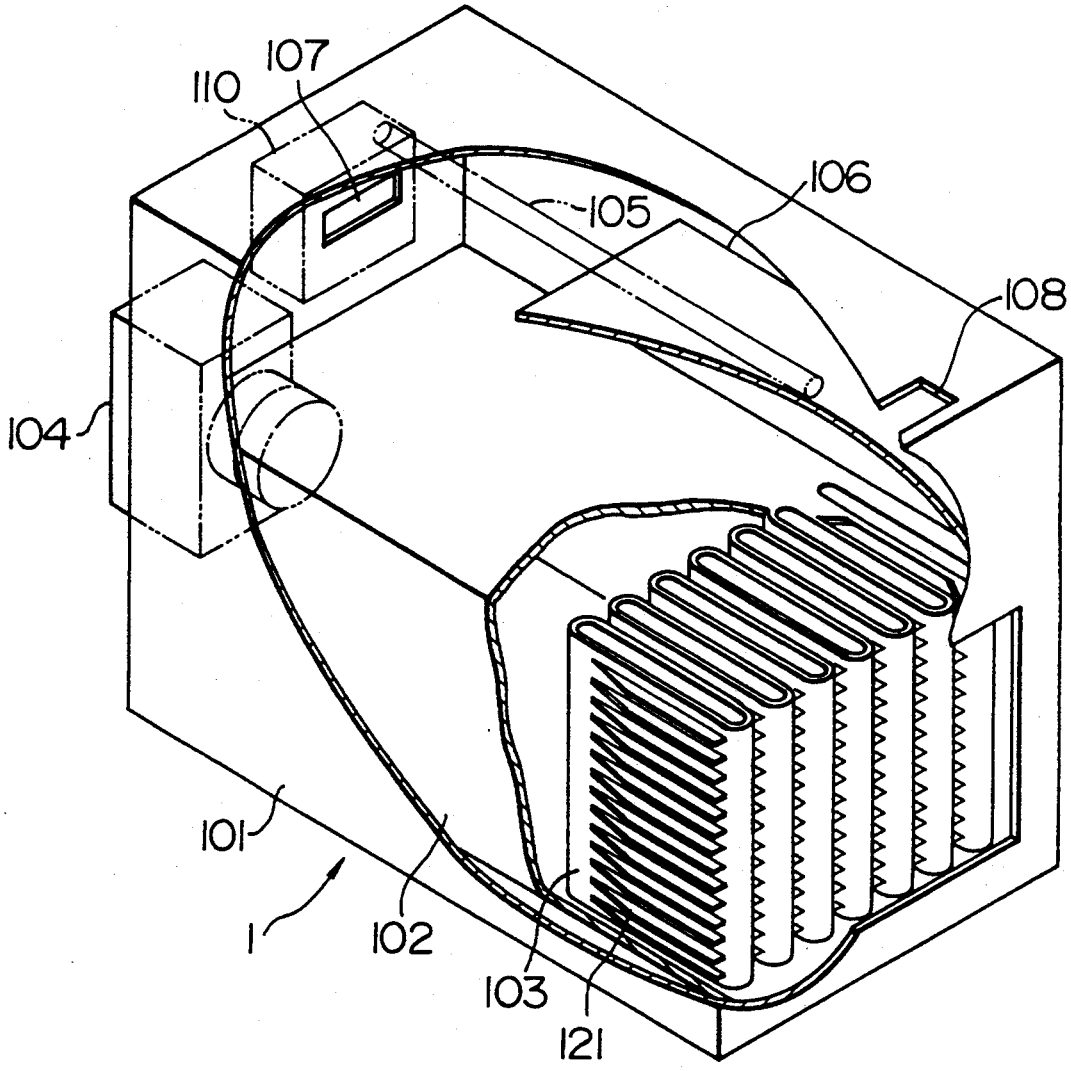
FIG. 4 is a partial cutaway perspective view of a high temperature regenerator in accordance with another embodiment of the present invention.
Figure 5:
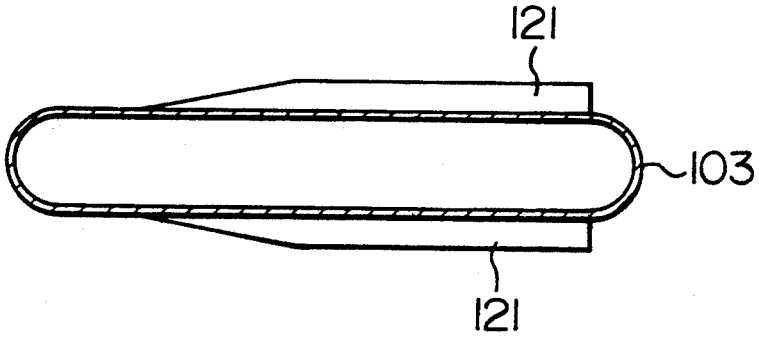
FIG. 5 is a horizontal sectional view of a solution pipe used in the high temperature regenerator of FIG. 4.
Figure 6:
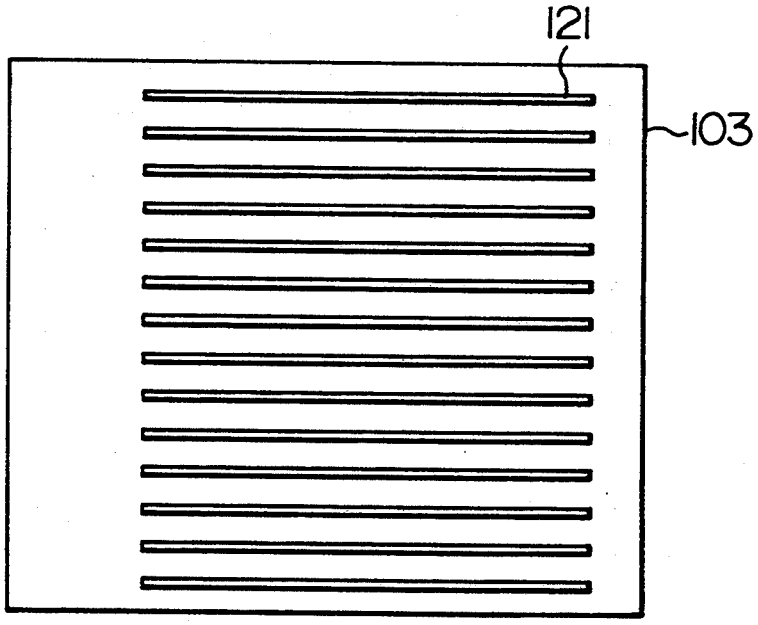
FIG. 6 is a side view of the solution pipe used in the high temperature regenerator of FIG. 4.

In the same manner as in the embodiment shown in FIG. 1, in the embodiment of FIGS. 4–6, a plurality of solution pipes 103 are disposed inside the inner case 102 of the high temperature regenerator so as to be substantially parallel to each other. The horizontal cross section of the solution pipe 103 is elliptical, and a plurality of heat transfer fins 121 are disposed horizontally on the flat plate surface of the solution pipes 103. The heat transfer fin 121 is so formed that its height increases from upstream toward downstream along the direction of the flow of the combustion gas until it becomes fixed in about the middle thereof. The other components of this embodiment are the same as those of the embodiment of FIG. 1.

According to the embodiment of FIGS. 4–6 in addition to the advantages of the embodiment of FIG. 1, since a heat transfer fin whose height varies along the direction of the flow of the combustion gas is disposed on the flat plate surface of the solution pipe, it is possible to make the heat flux uniform, and it is possible to increase the average heat flux while suppressing the progress of the corrosion. In addition, it is possible to miniaturize the high temperature regenerator 1.

Figure 7:
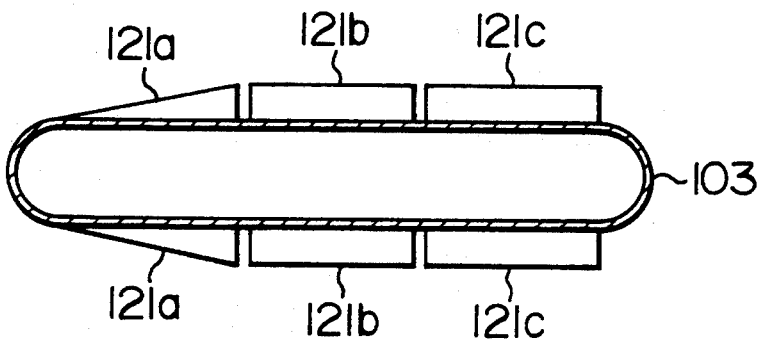
FIG. 7 is a horizontal sectional view of a solution pipe used in the high temperature regenerator in accordance with still another embodiment of the present invention.
Figure 8:
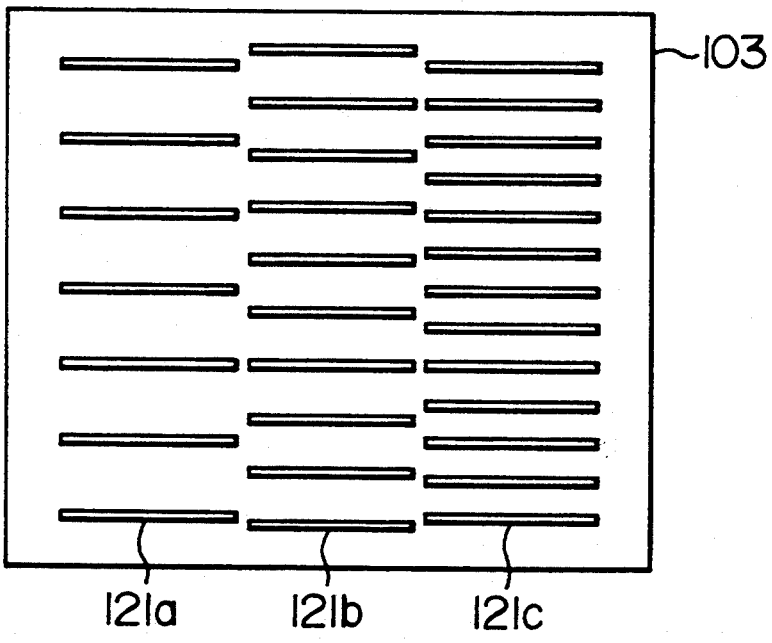
FIG. 8 is a side view of the solution pipe of FIG. 7.

In the embodiment of FIGS. 7 and 8, the plurality of solution pipes 103 are disposed inside the inner case 102 of the high temperature regenerator to be substantially parallel to each other in the same way as in the embodiment of FIG. 1. The horizontal cross section of the solution pipes 103 is elliptical, and the heat transfer fin 121 is disposed horizontally on the flat plate surface thereof.

Each of the heat transfer fins 121 is divided into three portions in the combustion gas flow direction. A divided fin 121*a* disposed in farthest upstream is shaped in such a manner that its height increases gradually from upstream toward downstream of the combustion gas flow direction, and divided fins 121*b* and 121*c* are formed to each have a fixed height. Regarding the divided fins 121*b* and 121*c*, the pitch of the fin 121*c* disposed in further downstream is smaller than that of the fin 121*b*. The respective fins are so designed that the mounting position thereof along the height of the solution pipe is not, as much as possible, the same as that of of the fin in the upstream portion. The other components are the same as those of the embodiment of FIG. 1. The inner case 102 and the solution pipes 103 can be easily assembled in such a manner that the upper and lower portions of the inner case 102 are cut in the opening portion to be joined to the outer case 101 so as to insert the solution pipes 103 from the opening portion side of the inner case 102 and that the cut upper and lower portions of the inner case 102 are joined to the solution pipes 103. Accordingly, the solution pipes 103 can be joined to the inner case 102 in spite of obstructions as the fins disposed on the outer surface of the solution pipes 103. It is also possible to assemble the solution pipes 103 and the inner case 102 by a method in which the inner case 102 is divided into two portions, an upper portion and a lower portion, solution pipes are arranged inside one of the divided inner cases, the other of the divided inner case is set thereon and the upper and lower inner cases are joined together.

According to this embodiment as described above, in addition to the advantages of the embodiment of FIG. 4, since the fin disposed in the solution pipe is divided in the direction of the combustion gas flow, and the fin pitch is varied so that the mounting pitch of the fin decreases from the upstream toward the downstream in the direction of the flow of the combustion gas, it is possible to make the heat flux even more uniform, and it is possible to increase the average heat flux even more while suppressing the progress of corrosion. In addition, the high temperature regenerator can be miniaturized.

Figure 9:
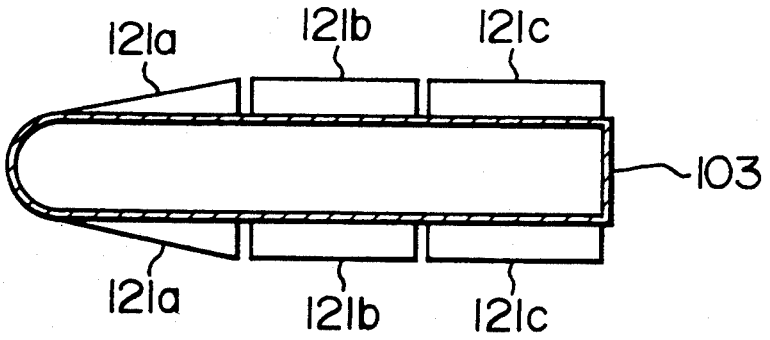
FIG. 9 is a horizontal sectional view of a solution pipe used in the high temperature regenerator in accordance with still another embodiment of the present invention.
Figure 10:
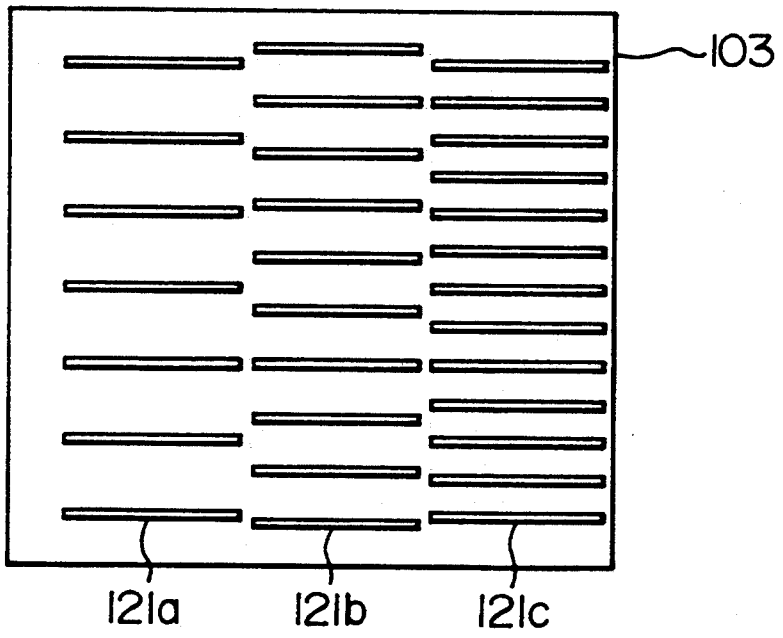
FIG. 10 is a side view of the solution pipe of FIG. 9.

In the embodiment of FIGS. 9 and 10, the plurality of solution pipes 103 are disposed inside the inner case 102 of the high temperature regenerator to be substantially parallel to each other in the same manner as in the embodiment of FIG. 1. The horizontal cross section of the solution pipe 103 in the upstream portion has an elliptical shape, and that in the downstream portion has a rectangular shape such that the solution pipe is cut at the downstream end portion of the fin in the embodiment of FIGS. 7 and 8. The heat transfer fin 121 is disposed on the flat plate surface of the solution pipe. Each of the heat transfer fins 121 is divided into three portions in the combustion gas flow direction. The farthest upstream fin 121*a* is shaped in such a manner that its height increases gradually from upstream toward downstream of the combustion gas flow direction, and fins 121*b* and 121*c* are formed to have fixed heights. Regarding the divided fins 121*b* and 121*c* in the downstream portion, the pitch of the fin 121*c* in the further downstream portion is smaller than that of the fin 121*b*. The respective fins are so designed that the mounting positions along the height of the solution pipes are, as much as possible, not the same as those of the fins in the upstream portion. The other components are the same as those of the embodiment of FIG. 1.

According to the embodiment of FIGS. 9 and 10, in addition to the advantages of the embodiment of FIG. 7, since the cross section of the solution pipe in the downstream portion has a rectangular shape such that the solution pipe of the fin in the embodiment of FIG. 7 is cut in the downstream portion, it is possible to mount the fin to the back end of the combustion gas passage, the heat transfer area can be effectively used, and miniaturization is made possible. Since the hardly-heated semi-circular portion at the downstream end of the fin is not provided in comparison with the embodiment of FIG. 7, it is possible to reduce a solution wasting portion, thereby making it possible to advantageously reduce costs. In addition, since the back end portion of the inner case is linear, there is an advantage, for example, assembling the inner case with the outer case and joining them together is facilitated.

Figure 11:
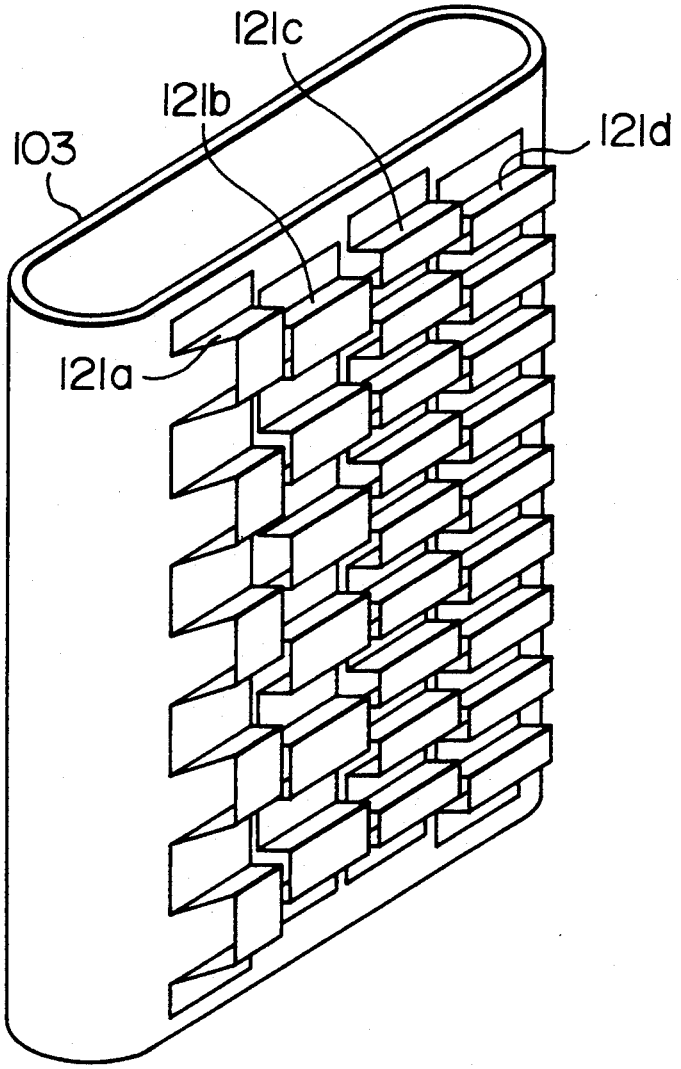
FIG. 11 is a perspective view of a solution pipe used in the high temperature regenerator in accordance with still another embodiment of the present invention.

In the embodiment shown in FIG. 11, each of the divided fins of the embodiment shown in FIGS. 9 and 10 has a corrugated plate shape. Also, the furthest upstream fin 121*a* along the flow of the combustion gas is so formed that its height increases gradually from upstream toward downstream of the combustion gas flow direction, and other fins 121*b*, 121*c* and 121*d* are formed each to have a fixed height. The pitches of the divided fins 121*a*, 121*b*, 121*c* and 121*d* in the downstream portion are smaller than those of the fins in the upstream portion. The respective fins are so designed that the mounting position thereof along the height of the solution pipes is, as much as possible, not the same as that of of the fin in the upstream portion.

According to this embodiment as described above, in addition to the advantages of the embodiment of FIG. 9, since a fin is formed as a single element having a corrugated plate shape, there is no need to mount fins separately on the solution pipe. Thus, there is an advantage in that joining of the fin to the solution pipe can be easily performed.

Figure 12:
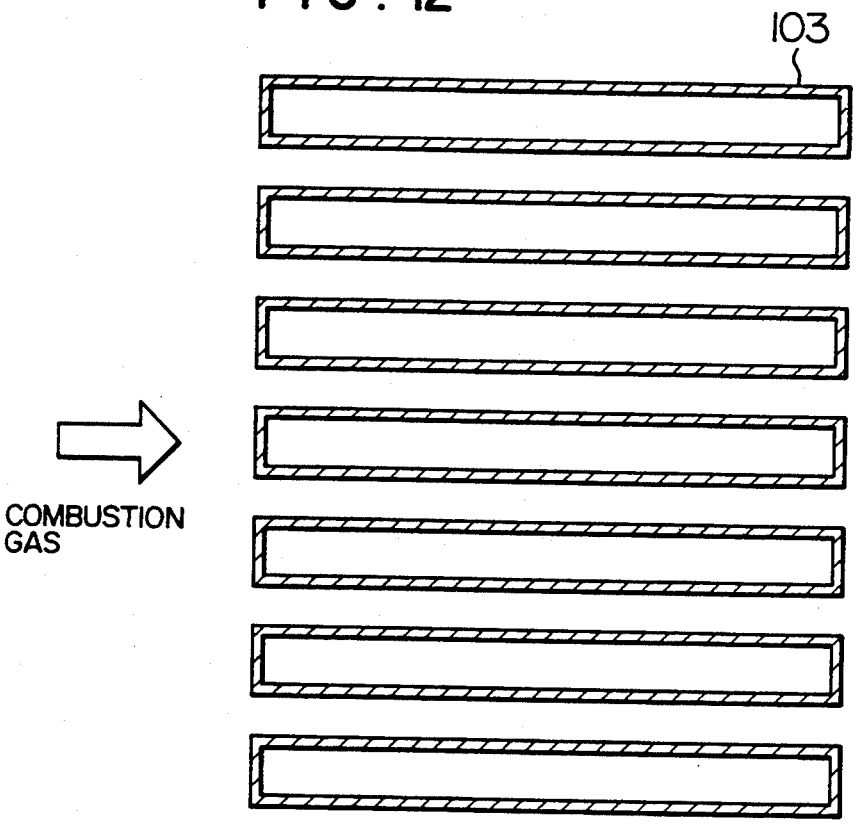
FIG. 12 is a horizontal sectional view which shows an arrangement and shapes of solution pipes used in the high temperature regenerator in accordance with still another embodiment of the present invention.
Figure 13:
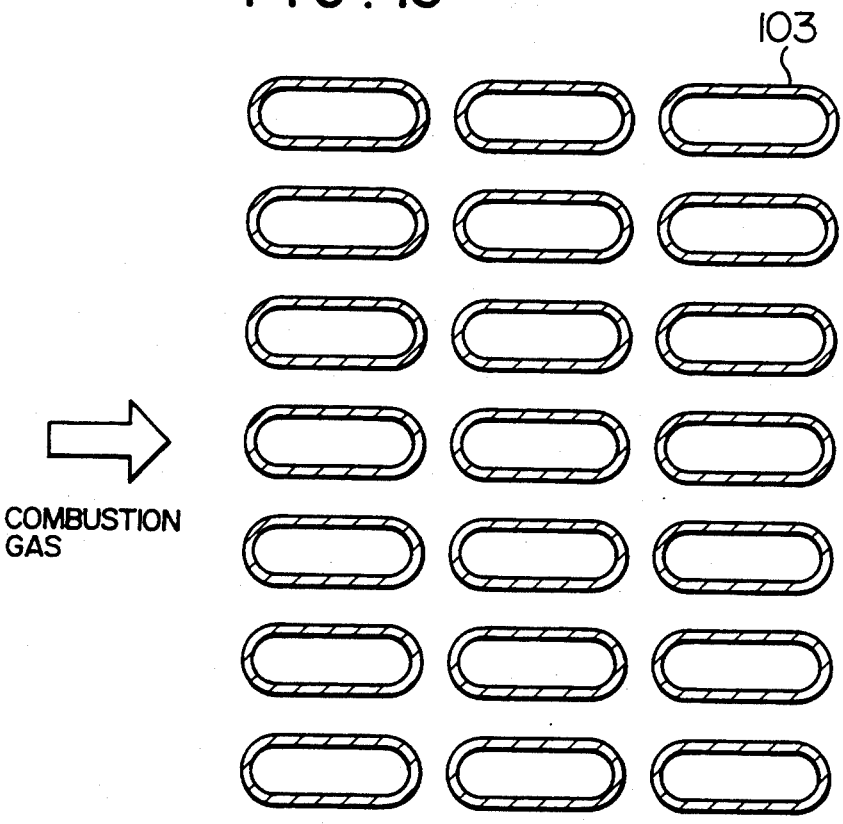
FIG. 13 is a horizontal sectional view which shows an arrangement and shapes of solution pipes used in the high temperature regenerator in accordance with still another embodiment of the present invention.
Figure 14:
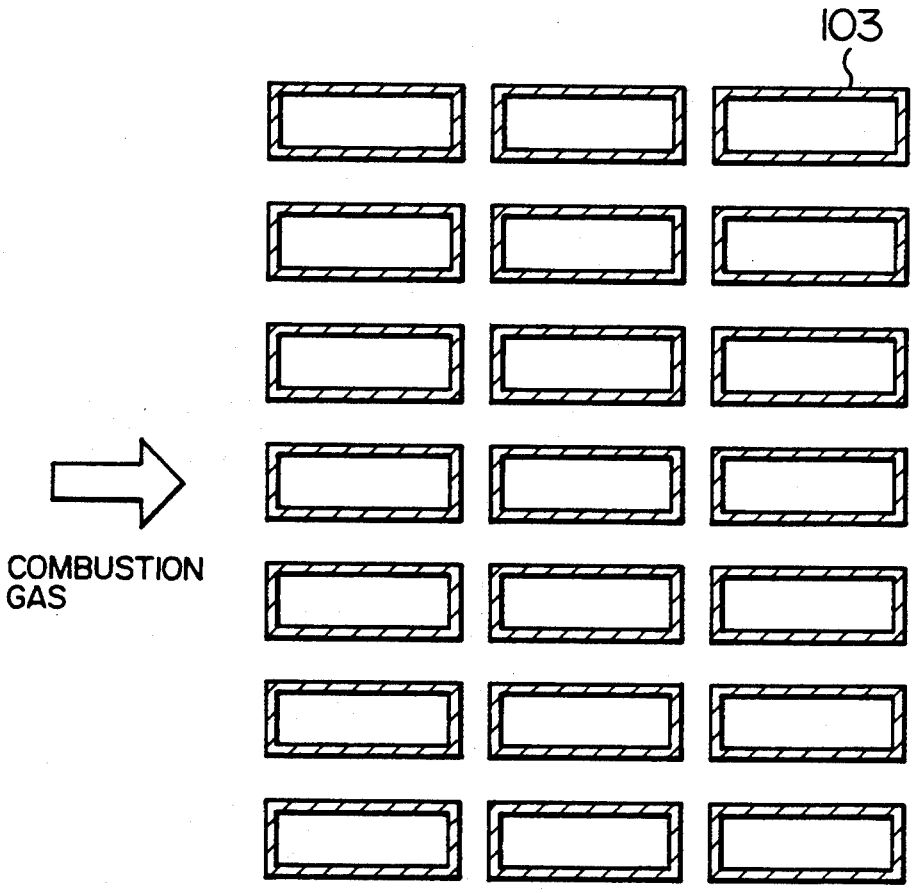
FIG. 14 is a horizontal sectional view which shows an arrangement and shapes of solution pipes used in the high temperature regenerator in accordance with still another embodiment of the present invention.

Although in the embodiment of FIGS. 9 and 10, the cross section of each of the solution pipes 103 for connecting the upper portion and the lower portion of the inner case to each other is shaped elliptical or shaped such that the downstream end thereof is cut, the same advantages as those of the embodiments described earlier can be obtained when a long narrow passage is formed by machining a square pipe of flat surfaces or a flat plate as shown in FIG. 12. Also, as shown in FIGS. 13 and 14, a plurality of elliptical or rectangular solution pipes 103 may be arranged along the flow of the combustion gas.

The height of the divided fins may be set to be fixed respectively and different for the respective divided fins. The solution pipe may be provided with the derided fins in such a manner that the downstream fins are higher than the upstream fins. When the fins in the upstream and downstream portions are mounted at different positions, the heat transfer performance is advantageously improved.

Figure 15:
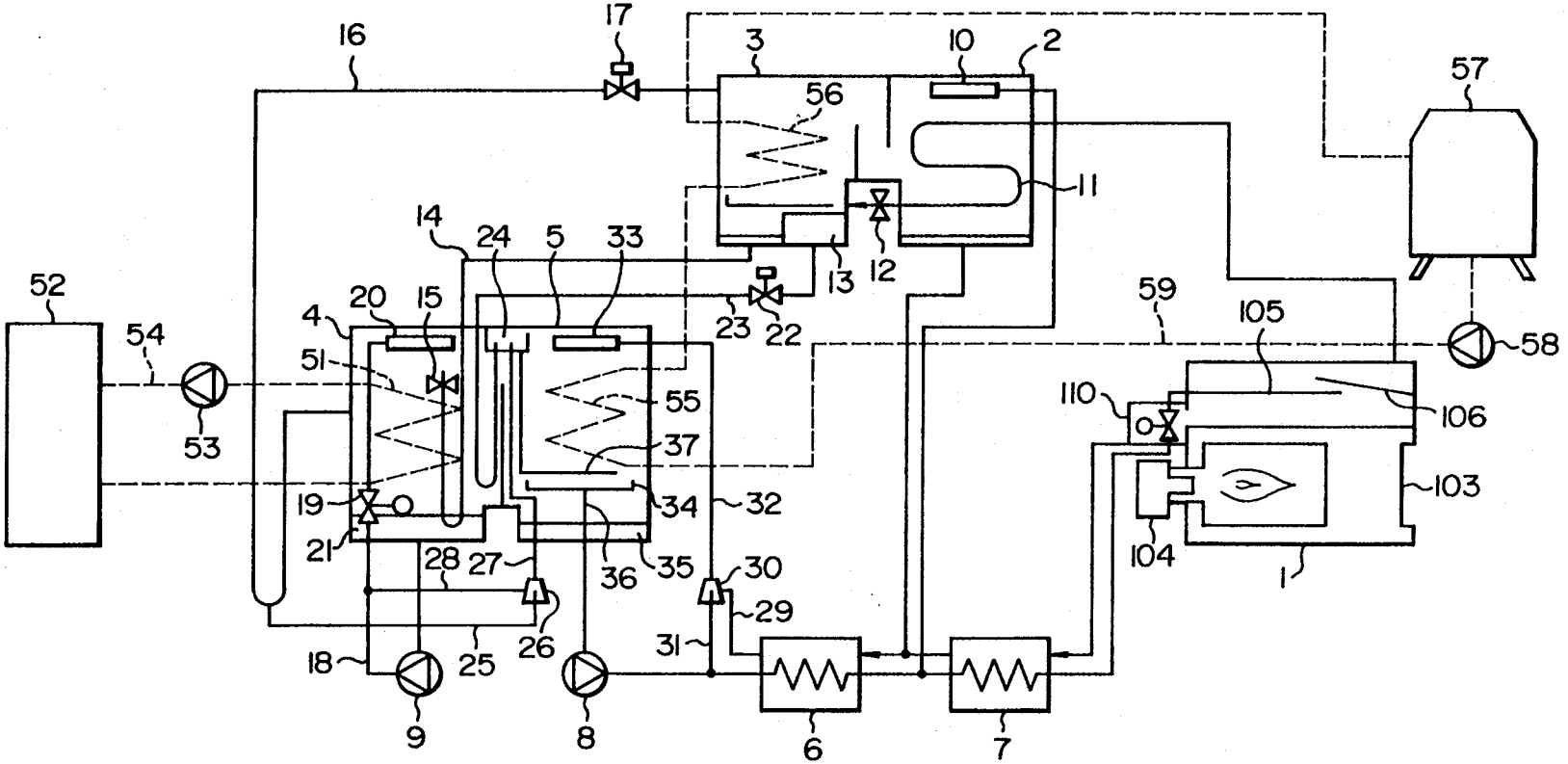
FIG. 15 is a schematic view of an absorption type air-conditioning system using the absorption type hot and cold water generator in accordance with the present invention.

As shown in the FIG. 15, the absorption type hot and cold water generator comprises the high temperature regenerator 1; a low temperature regenerator 2; the condenser 3; an evaporator 4; an absorbing unit 5; a low-temperature heat exchanger 6; a high-temperature heat exchanger 7; a solution circulating pump 8; a refrigerant pump 9; a heating burner 104; a spraying apparatus 10 for spraying a solution from the absorbing unit 5 into the low temperature regenerator 2; a heat transfer pipe 11, disposed inside the low temperature regenerator 2, for condensing the refrigerant vapor generated in the high temperature regenerator 1 and heat exchanging with a solution flowing downward outside the pipe; a throttle 12, disposed in the middle of the pipe by which the heat transfer pipe 11 is guided to the condenser 3; a refrigerant tank 13 disposed on the bottom of the condenser 3; a refrigerant liquid pipe 14 for guiding a liquid refrigerant from the condenser 3 via a U-shaped seal and a throttle 15 into the evaporator 4; a refrigerant vapor pipe 16 for connecting the gas phase portion of the condenser to the evaporator via a valve 17, which refrigerant vapor pipe 16 has a U-shaped seal portion in the middle thereof; a refrigerant pipe 18 for connecting the discharge portion of the refrigerant pump 9 to a refrigerant spraying apparatus 20 via a float valve 19; a refrigerant tank 21 disposed in the lower portion of the evaporator 4; a refrigerant blow pipe 23 for connecting the refrigerant tank 13 of the condenser 3 to a refrigerant receiver 24 disposed in the top portion of the evaporator 4 and the absorbing unit 5 via a refrigerant blow valve 22; a refrigerant pipe 25 for connecting the bottom portion of the U-shaped seal portion of the refrigerant vapor pipe 16 to an air-bubble blowout portion 26 of an air-bubble pump; a lifting pipe 27 of the air-bubble pump arranged in the top portion of the air-bubble blowout portion 26 of the air-bubble pump and whose top portion opens into the refrigerant receiver 24; a refrigerant pipe 28 which branches out from the mid-portion of the length of the refrigerant pipe 18 and is connected to the air-bubble blowout portion 26 of the air-bubble pump; a solution return pipe 29 for connecting the low temperature heat exchanger 6 to an ejector pump 30; a solution pipe 31, which branches in the middle of the pipe for supplying a solution from the solution circulating pump 8 to the low temperature heat exchanger 6, for supplying the solution to the ejector pump 30; a solution pipe 32 for guiding the solution from the ejector pump 30 to a solution spraying apparatus 33; a solution tray 34 disposed in the lower portion of the absorbing unit 5; a solution pipe 36 for connecting the solution tray 34 to a solution tank 35 in the lower portion of the absorbing unit 5; a refrigerant spraying pipe 37 for spraying the refrigerant from the refrigerant receiver 24 to the solution tray 34; a hot and cold water pipe 54 for circulating hot and cold water among the refrigerant spraying pipe 37, an evaporation heat transfer pipe 51 disposed inside the evaporator 4 and an indoor unit 52 by means of a hot and cold water pump 53; and a cooling water pipe 59 for circulating cooling water among an absorption heat transfer pipe 55 disposed inside the absorbing unit 5, a condensed heat transfer pipe 56 disposed inside the condenser 3, and a cooling tower 57 by means of a cooling water pump 58.

The system is operated as follows during a cooling operation, with the valve 17 and the refrigerant blow valve 22 being closed during the cooling operation.

The solution in the solution tank 35 disposed in the lower portion of the absorbing unit 5 is sent to the low temperature heat exchanger 6 by the solution circulating pump 8, after which a part of the solution is sent to the high temperature regenerator 1 through the high temperature heat exchanger 7, and the remainder is sent to the low temperature regenerator 2 and sprayed from the spraying apparatus 10. The solution sent to the high temperature regenerator 1 is heated by the burner 104 to boil to generate refrigerant vapor. The generated refrigerant vapor is supplied to the low temperature regenerator 2 and condensed inside the pipe of the heat transfer pipe 11, after which it is supplied to the condenser 3 through the throttle 12. The condensation heat at this time heats the solution sprayed from the spraying apparatus 10 and flowing downward outside the heat transfer pipe 11, generating refrigerant vapor again. The generated refrigerant vapor is sent to the condenser 3, chilled by the cooling water flowing through the condensed heat transfer pipe 56 and condensed, merged with the refrigerant from the high temperature regenerator 1, and collected in the refrigerant tank 13; whereas the high-concentration solution concentrated as a result of refrigerant vapor being generated in the high temperature regenerator 1 overflows from the high temperature regenerator 1 and is sent to the high temperature heat exchanger 7 via the float box 110. After heat exchange with a dilute solution from the absorbing unit is performed by the high temperature heat exchanger 7, the dilute solution is merged with the high-concentration solution from the low temperature regenerator 2. The merged high-concentration solution is heat exchanged with the dilute solution from the absorbing unit 5 in the low temperature heat exchanger 6, so that its temperature is further decreased. The solution is supplied to the solution spraying apparatus 33 by the ejector pump 30 through the solution return pipe 29 and the solution pipe 32, and sprayed into the absorbing unit 5. The sprayed high-concentration solution absorbs the refrigerant vapor from the evaporator 4 while being chilled by the cooling water flowing through the absorption heat transfer pipe 55, its concentration being decreased, collected by the solution tray 34 and returned to the solution tank 35 through the solution pipe 36; whereas the liquid refrigerant stored in the refrigerant tank 13 disposed in the lower portion of the condenser 3 overflows from the refrigerant tank 13 and flows into the evaporator 4 via the refrigerant liquid pipe 14 and the throttle 15. In the evaporator 4, the liquid refrigerant in the refrigerant tank 21 disposed in the lower portion of the evaporator 4 is supplied to the refrigerant spraying apparatus 20 through the refrigerant pipe 18 and the float valve 19 by the refrigerant pump 9, sprayed onto the evaporation heat transfer pipe 51 disposed inside the evaporator 4, heat exchanged with the cooling water flowing through the pipe group and is evaporated. As a result, evaporation latent heat is drained from the cooling water, and thus a refrigerating effect can be obtained. The evaporated refrigerant flows out to the absorbing unit 5 and is absorbed by the high-concentration solution flowing downward inside the absorbing unit 5.

On the other hand, the cooling water chilled by a cooling tower 57 is supplied to the absorbing unit 5 by a cooling water pump 58, its absorbing heat being drained by the absorption heat transfer pipe 55 so that its temperature is increased. Next, the cooling water is sent to the condenser 3 and its condensation heat is drained by the condensed heat transfer pipe 56 so that its temperature is increased even more. Thereafter, the cooling water is returned to the cooling tower 57 where it is chilled. The cooling water chilled by the evaporation heat transfer pipe 51 disposed inside the evaporator 4 is supplied to the indoor unit 52 by the hot and cold water pump 53 to cool the interior thereof. As a result, the temperature of the cooling water increases, and it is then returned to the evaporator.

When a cooling load is no longer present during the cooling operation, an absorption hot and cold water generator stop signal is issued, and the hot and cold water pump 53, the cooling water pump 58, the cooling tower 57 and the burner 104 are immediately stopped. The refrigerant pump 9 is also stopped at the same time. The solution circulating pump 8, however, continues to operate for a fixed period of time in order to dilute the high-concentration solution within the cycle, and the refrigerant blow valve 22 is opened to prevent the refrigerant from being refrigerated, so that the refrigerant in the refrigerant tank 13 is mixed with the solution on the solution tray 34 through the refrigerant blow pipe 23, the refrigerant receiver 24, and the refrigerant spraying pipe 37 and diluted. By decreasing the concentration of the solution, the refrigerant vapor absorbing performance of the solution is decreased, making it possible to prevent the refrigerant and the hot and cold water from being refrigerated.

On the other hand, the system operates as follows during a warming operation, the valve 17 and the refrigerant blow valve 22 being open during the warming operation. The cooling water pump 58 is stopped, and no cooling water is made to flow into the absorption heat transfer pipe 55 disposed inside the absorbing unit 5 and the condensation heat transfer pipe 56 disposed inside the condenser 3. Also, the refrigerant pump 9 is stopped.

After the solution in the solution tank 35. Disposed in the lower portion of the absorbing unit 5, is supplied to the low temperature heat exchanger 6 by the solution circulating pump 8, a portion thereof passes through the high temperature heat exchanger 7 and is sent to the high temperature regenerator 1, the remainder being supplied to the low temperature regenerator 2 and sprayed from the spraying apparatus 10. The solution sent to the high temperature regenerator 1 is heated to boil by the burner 104, generating refrigerant vapor. The generated refrigerant vapor is supplied to the low temperature regenerator 2 and condensed inside the pipe of the heat transfer pipe 11, after which it is passed through the throttle 12 and sent to the condenser 3. The condensation heat at this time heats the solution flowing downward outside the heat transfer pipe 11, causing refrigerant vapor to be generated again. The generated refrigerant vapor is supplied to the condenser 3. However, since cooling water does not flow through the pipe group disposed inside the condenser 3, the refrigerant vapor is not condensed and liquefied; instead, it is sent to the evaporator 4 via the valve 17 and the refrigerant vapor pipe 16. A part of the refrigerant vapor is supplied from the U-shaped seal portion of the refrigerant vapor pipe 16 through the refrigerant pipe 25, the air-bubble blowout portion 26 and the lifting pipe 27 to the refrigerant receiver 24, and then sent from the refrigerant spraying pipe 37 onto the solution tray 34 of the absorbing unit 5. The liquid refrigerant from the high temperature regenerator 1 is supplied to the evaporator 4 via the refrigerant blow pipe 23 and the refrigerant blow valve 22. In the evaporator 4, the refrigerant vapor from the condenser 3 is heat exchanged with the hot water flowing through the evaporation heat transfer pipe 51, then condensed and liquefied. Since the condensation latent heat at this time heats the hot water, warming performance is effected. The condensed and liquefied refrigerant is stored in the refrigerant tank 21, sent to the air-bubble blowout portion 26 of the air-bubble pump through the refrigerant pipe 28 which branches out from the mid-portion of the length of the refrigerant pipe 18, raised inside the lifting pipe 27 by the action of the air-bubble pump and made to flow into the refrigerant receiver 24, and then discharged from the refrigerant spraying pipe 37 onto the solution tray 34 of the absorbing unit 5. On the other hand, the high-concentration solution concentrated as a result of the refrigerant vapor being generated by the high temperature regenerator 1 is supplied from the high temperature regenerator 1 via the float box 110 to the high temperature heat exchanger 7. The solution is heat exchanged with the dilute solution from the absorbing unit 5 in the high temperature heat exchanger 7, with the temperature of the solution thus being decreased, after which the solution merges with the high-concentration solution from the low temperature regenerator 2. The merged high-concentration solution is heat exchanged with the dilute solution from the absorbing unit 5 in the low temperature heat exchanger 6, the temperature of the solution thus being further decreased. Thereafter, the solution is supplied to the solution spraying apparatus 33 through the solution return pipe 29 and the solution pipe 32 by the ejector pump 30 and sprayed into the absorbing unit 5. Since cooling water is not flowing through the absorption heat transfer pipe 55, the sprayed high-concentration solution flows downward through the absorption heat transfer pipe 55, merges with the liquid refrigerant on the solution tray 34, passes through the solution pipe 36 and returns to the solution tank 35.

The hot water, heated by the evaporation heat transfer pipe 51 disposed inside the evaporator 4, is supplied to the indoor unit 52 by the hot and cold water pump 53 to warm the interior. As a result, the temperature of the hot water is decreased, and it is then returned to the evaporator 4 again.

According to this embodiment, since the high temperature regenerator is miniaturized, the absorption type hot and cold water generator can be miniaturized.

According to the present invention, since there is no place where combustion gas stagnates and a heat load becomes small, the average heat flux can be increased and the high temperature regenerator can be miniaturized. As a result, it is possible to miniaturize the absorption type hot and cold water generator by using the high temperature regenerator.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the claims. The following claims are to be accorded the broadest interpretation, so as to encompass all such modifications and equivalent structures and functions.

What is claimed is:

1. A high temperature regenerator of an absorption type hot and cold water generator comprising:

an outer case;

an inner case;

a plurality of solution pipes;

a liquid chamber for holding a solution being formed in a section between the outer case and the inner case;

a combustion chamber through which a combustion gas for heating the solution flows being formed inside the inner case; and said plurality of solution pipes being arranged downstream of the combustion gas flow inside said combustion chamber, wherein each of said plurality of solution pipes is vertically connected to said liquid chamber so that the inside of each of the solution pipes is filled with a solution and the solution does not enter the space of the combustion chamber outside said solution pipes, a cross of each of said plurality of solution pipes is flat with respect to the flow of said combustion gas, wherein the solution in the solution pipes is heated by a convective heat transfer such that the solution flows vertically, and wherein said cross section of each of said solution pipes is shaped as part of an ellipse in the upstream portion along the flow of said combustion gas, and a part of a rectangle in the downstream portion.

2. A high temperature regenerator of an absorption type hot and cold water generator according to claim 1, wherein heat transfer fins are disposed on each of said solution pipes.

3. A high temperature regenerator of an absorption type hot and cold water generator according to claim 1, wherein heat transfer fins whose height increases gradually from upstream toward downstream along the direction of the flow of said combustion gas are disposed on each of said solution pipes.

4. A high temperature regenerator of an absorption type hot and cold water generator according to claim 1, wherein heat transfer fins each of which is divided into a plurality of portions in the combustion gas flow direction are disposed on each of said solution pipes and wherein a fin pitch thereof is varied so as to decrease from upstream toward downstream along the direction of the flow of said combustion gas.

5. A high temperature regenerator of an absorption type hot and cold water generator according to claim 1, wherein heat transfer fins each of which is divided into a plurality of portions in the combustion gas flow direction, the respective divided heat transfer fins being formed to be integral in the corrugated plate shape, are disposed on each of said solution pipes and wherein a fin pitch thereof is varied so as to decrease from upstream toward downstream along the direction of the flow of said combustion gas.

* * * * *